United States Patent [19]

Koser

[11] 4,102,169

[45] Jul. 25, 1978

[54] METHOD AND APPARATUS FOR PIPE BENDING

[75] Inventor: Rolf Koser, Osterheide, Fed. Rep. of Germany

[73] Assignee: Sidro GmbH & Co. Ludwig Moller, Bunde, Fed. Rep. of Germany

[21] Appl. No.: 740,955

[22] Filed: Nov. 11, 1976

[30] Foreign Application Priority Data

Feb. 13, 1976 [DE] Fed. Rep. of Germany ..... 2605795

[51] Int. Cl.[2] ..... B21D 9/00

[52] U.S. Cl. ..... 72/128; 29/157 A; 72/131; 72/132; 72/369

[58] Field of Search ..... 29/157 A; 72/128, 129, 72/130, 131, 132, 149, 150, 367, 369

[56] References Cited

U.S. PATENT DOCUMENTS

| | | | |
|---|---|---|---|
| 1,675,300 | 6/1958 | Dawson | 72/132 |
| 2,206,519 | 7/1940 | Taylor | 72/128 |
| 3,041,715 | 7/1962 | Norton | 72/132 |
| 3,172,450 | 3/1965 | Hockman et al. | 72/131 |
| 3,677,046 | 7/1972 | Carroll | 72/129 |
| 3,956,916 | 5/1976 | Herkner et al. | 72/129 |
| 4,043,167 | 8/1977 | Koser | 29/157 A |

FOREIGN PATENT DOCUMENTS

| | | | |
|---|---|---|---|
| 1,600,798 | 9/1970 | France | 72/129 |
| 1,900,908 | 10/1970 | Fed. Rep. of Germany | 72/367 |
| 456,403 | 11/1936 | United Kingdom | 72/150 |

*Primary Examiner*—E. M. Combs

*Attorney, Agent, or Firm*—William Anthony Drucker

[57] ABSTRACT

The invention provides an improved method and apparatus for pipe bending. In the method a leading portion of a length of pipe is heated and bent around a mandrel into a pipe bend, whereafter it is hot calibrated or sized to finished dimensions and at the same time cut off and trimmed to size at both ends. In a machine for carrying out the method, there are a heating chamber and an interchangeable bending mandrel. At the end of the bending mandrel there is a horizontally functioning calibrating or sizing device. A severing device is both in front of and behind the calibrating device for cutting off and trimming the pipe bend, and the pipe bend is movable both longitudinally and/or transversely in the horizontal plane.

5 Claims, 4 Drawing Figures

METHOD AND APPARATUS FOR PIPE BENDING

This invention relates to a method for the manufacture of individual pipe bends with a radius of curvature between 15° and 180°, and also a pipe bending machine for carrying out the method.

Methods for the manufacture of unworked pipe bends are known in the present state of the art. The same applies to the corresponding machines, equipment and devices. Familiarity with pipe bending methods is essential today in the relevant manufacturing spheres, because the bending of pipes, of all types, is a daily procedure. With existing manufacturing procedures, all pipe bends fitted over a mandrel, irrespective of whether hot or cold working is used, are made in precalculated working lengths, that is to say, the pipes are cut to the appropriate lengths. These pipe sections are fitted one after the other onto a mandrel to which a bending mandrel is connected. With this method, the section of pipe is shaped into a pipe bend. The curved unworked pipe bend drops out of the machine at a temperature of between 700° and 900° celsisus. The unworked pipe bends are calibrated or sized to finished dimensions in a subsequent operation in an apropriate machine or device.

After cooling sufficiently, the pipe bend enters a sawing device in which the pipe bend is cut by saws or cutting-off discs. At this sawing or cutting stage, the dimensional accuracy of the pipe bend is in the upper tolerance range. This tolerance range is sometimes even exceeded, and subsequent finishing in the form of cold calibration is necessary. This cold calibration is solely a matter of calibrating the ends, that is to say, the ends of the pipe bend are brought to the prescribed connecting size within the tolerance zone. All the subsequent work necessary to adhere to the tolerances involves much expense, as the bulk of it has to be done by hand.

In view of the above-mentioned shortcomings in the known procedures, the object of the present invention is to provide a method, and a machine functioning in accordance therewith, whereby the continuous production of pipe bends, accompanied by finished manufacture, is made possible.

The method according to the invention solves the problem in that the leading portion of a limited length of piping is heated, is fitted over a bending mandrel, and is bent into a pipe bend, after which this pipe bend is hot calibrated and at the same time cut off or trimmed to size at both ends.

To carry out the method described above the machine, which is equipped with a heating chamber and an interchangeable bending mandrel, has at the end of the bending mandrel a horizontally functioning calibrating device and, both in front of and behind the latter, there is a severing device for cutting off and trimming the pipe bend, which device can be moved longitudinally and/or transversely in the horizontal plane.

According to a further feature of the invention, the severing device disposed in front of the calibrating device is mounted on a separate cradle near the floor and can be moved by means of an electromotor via racks and pinions, toothed belts or similar auxiliary equipment.

A further feature of the invention is that the severing device disposed behind the calibrating device, and which effects the vertical severing cut, is constructed to be movable both longitudinally and transversely to the length of piping and is disposed near the floor on a double cradle.

Finally, it should be mentioned that the severing element of each severing device is constructed in the form of a saw blade, a cutting-off disc or an electrolyte, driven by an electromotor.

Two embodiments of the invention are hereinafter described by way of example in greater detail with reference to the accompanying drawing, wherein.

Figure 1:
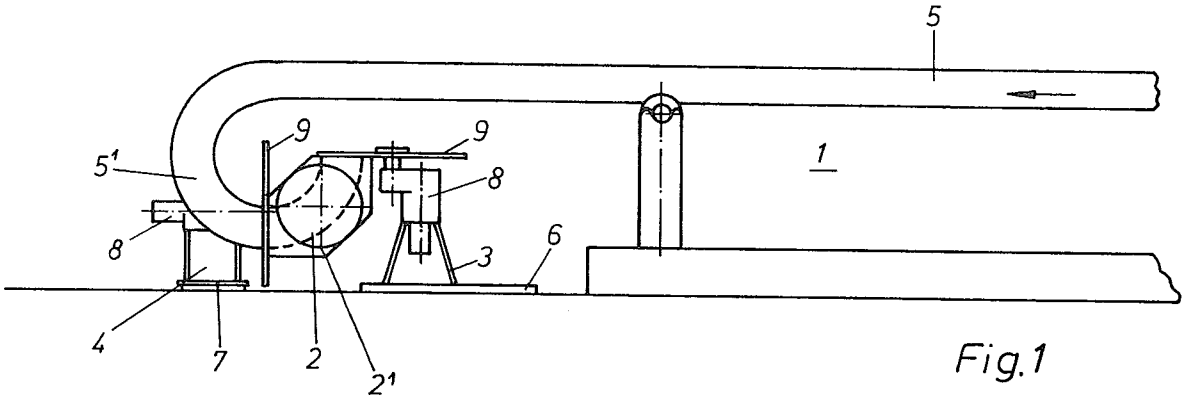
FIG. 1 is a schematic side elevation of the pipe bending machine.
Figure 2:
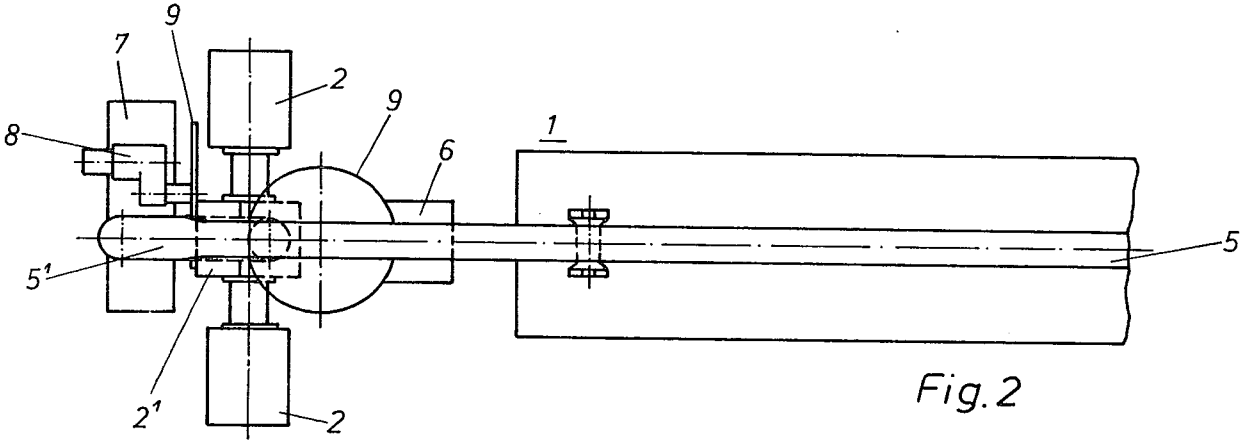
FIG. 2 is a corresponding plan view.

In the drawings, the limited length of piping is indicated by 5. The pipe bending machine, which is of a known type, bears the number 1. Because this machine 1 does not, in terms of the bending process, represent anything which is of itself new, it is unnecessary to go in any detail into the design thereof. What is new and inventive is that a calibrating device 2 is fitted to a conventional pipe bending machine. This calibrating device 2 is disposed in the bending delivery sector and operates in the horizontal plane, see FIG. 2. Two severing devices 3 and 4 are disposed in front of and behind this calibrating device 2. The severing devices 3, 4 are mounted in or on a cradle 6 or 7 near the floor, so that they can be moved. Movement of the cradles 6, 7 is effected by means of an electromotor via racks and pinions, toothed belts or similar auxiliary equipment. Whilst the severing device 3 in the cradle 6 can be moved only longitudinally or transversely, the severing device 4 is arranged so that it can be moved both longitudinally and transversely in its cradle 7. For this purpose, 7 is in the form of a double cradle. Severing devices 3 and 4 each have a motor 8 driving a rotary cutting element 9.

The details of the operating cycle of the method are as follows:

The length of piping 5 is fitted over a mandrel of known type and passed round a bending mandrel. When the pipe bend $5^1$ emerging continuously out of the bending machine has reached the appropriate length and curvature, the forward movement of the length of piping 5 is momentarily interrupted. During the interruption of this advance, the cheeks $2^1$ of the calibrating device 2 close and, at the same time, that is during the calibrating step, the two severing devices 3, 4 move into the recess and then sever the pipe bend $5^1$ at the required number of degrees. When the calibrator cheeks $2^1$ are opened, the pipe bend $5^1$ drops out of the pipe bending machine ready for use. Protracted and costly additional work on the pipe bend $5^1$ to achieve the prescribed tolerances is no longer necessary.

Figure 3:
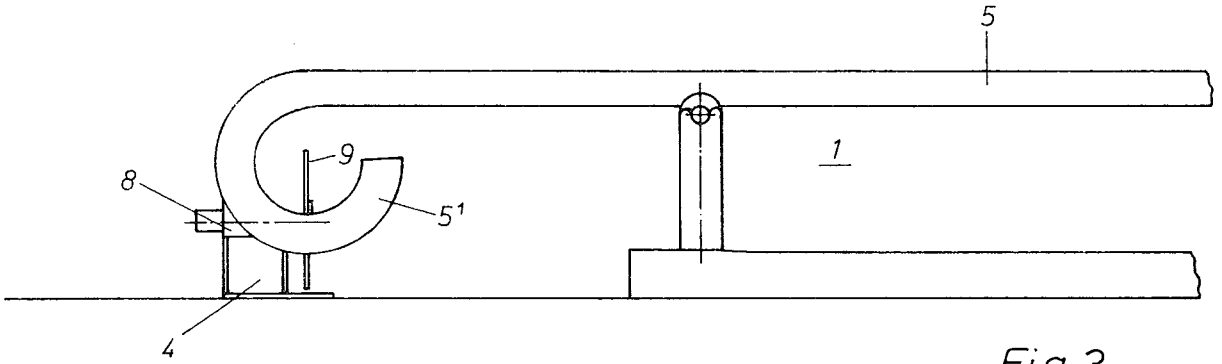
FIG. 3 is a side elevation of a severing machine.
Figure 4:
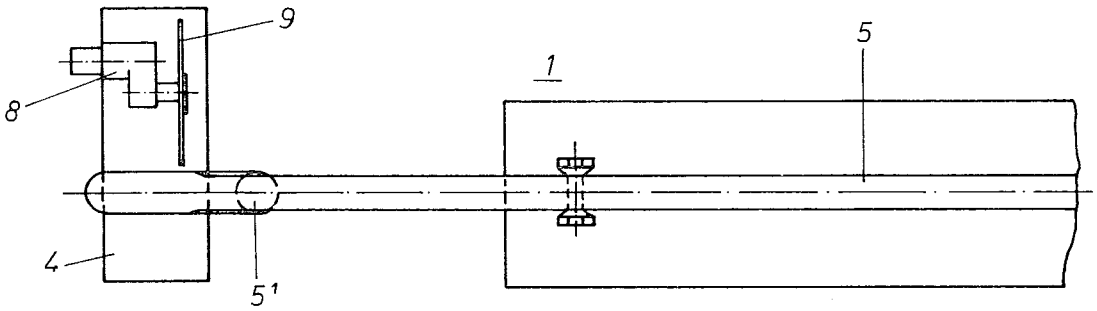
FIG. 4 is a plan view corresponding to FIG. 3.

It is also possible, for the continuous production of pipe bends $5^1$, to use only the severing device 4. In this version, shown in FIGS. 3 and 4, the severing device 4 moves during the cutting operation in conformity with the advance of the length of piping 5 in the direction of ejection of the pipe bend $5^1$. The forward movement of the severing device 4 can, inter alia, be of a floating nature. The longitudinal advance of the severing device 4 is extremely small and has no adverse effect on the cut as such.

I claim:

1. A method for the production, from a run of linear pipe of indefinite length, of pipe bends which are cut to a required length and hot-calibrated and do not require any further treatment, said method comprising the steps of:

(i) heating an end portion of said linear pipe run to a temperature suitable for forming a bend in said end portion;

(ii) while said end portion is at said temperature, forming a bend therein; then (iii) while said bent end portion is still at said temperature, calibrating or sizing said end portion to finished dimensions; and, (iv) while said calibrated bent end portion is still at said temperature, severing said end portion at two axially spaced points thereon to provide a calibrated cut pipe bend.

2. A pipe bending machine comprising:

(i) means for heating an end portion of a run of linear pipe of indefinite length to a temperature suitable for forming a bend therein;

(ii) means for forming said heated end portion into a bend;

(iii) a calibrating or sizing device, adapted to act radially on said heated bent end portion, for sizing said heated end portion to finished dimensions;

(iv) a first severing device situated at one side of the calibrating device, considered in the circumferential direction of the pipe bend, for severing said heated end portion at a first axial point thereon, and (v) a second severing device situated at the other side of the calibrating device, considered in the circumferential direction of the pipe bend, for severing said heated end portion at a second axial point spaced from said first axial point to provide a calibrated cut pipe bend.

3. A pipe bending machine, as claimed in claim 2, wherein said first severing means is arranged to sever the heated end portion in a plane parallel to the axis of the linear run of pipe, and wherein said second severing means is arranged to sever the heated end portion in a plane normal to the axis of the linear run of pipe, said second severing means being movable parallel to the axis of the linear run of pipe.

4. A pipe bending machine, as claimed in claim 2, wherein said means for forming said end portion into a bend is a mandrel, and wherein said calibrating or sizing device comprises a plurality of jaws which can be moved apart and brought together calibrate the pipe bend, and wherein each said severing device is a rotary cutter.

5. A pipe bending machine, as claimed in claim 2, wherein said severing devices are each mounted on a respective guide movable by drive means including an electric motor.

* * * * *